US005421277A

United States Patent [19]

Conley, Jr. et al.

[11] Patent Number: 5,421,277

[45] Date of Patent: Jun. 6, 1995

[54] WORKPIECE PALLET HAVING A DETACHABLE WORKPIECE HOLDER

[75] Inventors: Ralph F. Conley, Jr., Miamisburg; Richard A. Cefola, Centerville, both of Ohio

[73] Assignee: MIM Industries, Inc., Miamisburg, Ohio

[21] Appl. No.: 944,049

[22] Filed: Sep. 11, 1992

Related U.S. Application Data

[63] Continuation-in-part of Ser. No. 676,798, Mar. 28, 1991.

[51] Int. Cl.[6] ..... D05B 21/00

[52] U.S. Cl. ..... 112/121.12; 112/121.15

[58] Field of Search ..... 112/121.12, 121.15, 112/102, 103, 113, 114, 2, 104, 262.1, 262.3, 266.1; 38/102.2

[56] References Cited

U.S. PATENT DOCUMENTS

| | | | |
|---|---|---|---|
| 164,241 | 6/1875 | Wheeler . | |
| 278,485 | 5/1883 | Arnold . | |
| 1,222,618 | 4/1917 | Gammons . | |
| 1,387,034 | 8/1921 | Barron et al. . | |
| 1,569,231 | 1/1926 | Mayo . | |
| 2,223,626 | 12/1940 | Ladue | 112/2 |
| 2,630,087 | 3/1953 | Liero et al. | 112/114 |
| 2,726,613 | 12/1955 | Eddy | 112/114 |
| 3,104,637 | 9/1963 | Hedegaard | 112/104 |
| 3,664,283 | 5/1972 | McFalls | 112/121.15 |
| 3,664,288 | 5/1972 | Von Boden et al. | 112/103 |
| 3,799,086 | 3/1974 | Block . | |
| 3,830,175 | 8/1974 | Levor . | |
| 3,875,877 | 4/1975 | Fox | 112/63 |
| 3,875,878 | 4/1975 | Kaminski | 112/116 |
| 3,988,993 | 11/1976 | Brophy . | |
| 4,171,672 | 10/1979 | Dorosz et al. . | |
| 4,273,059 | 6/1981 | Kamal . | |
| 4,296,699 | 10/1981 | Vartoukian . | |
| 4,305,338 | 12/1981 | Adamson | 112/113 |

(List continued on next page.)

FOREIGN PATENT DOCUMENTS

| | | |
|---|---|---|
| 888574 | of 0000 | United Kingdom . |
| 991161 | of 0000 | United Kingdom . |
| 2017769 | of 0000 | United Kingdom . |
| 2143550 | of 0000 | United Kingdom . |
| 2167456 | of 0000 | United Kingdom . |

OTHER PUBLICATIONS

"The Technologies of MIM Industries, Inc.", published approximately Jan. 1, 1990.

*Primary Examiner*—Peter Nerbun
*Attorney, Agent, or Firm*—Biebel & French

[57] ABSTRACT

A workpiece pallet for transporting and holding one or more workpieces to be sewn in a programmable sewing machine. The workpiece pallet comprises a frame member having a locator which can be removably secured to the frame member. In a preferred embodiment, the locator comprises a base plate having a plurality of flanges which cooperate with mating flanges on the frame member so that the base plate is detachably supported therein. The base plate has a plurality of posts which facilitate locating one or more workpieces in the workpiece pallet. The workpiece pallet also comprises a universal coupler for permitting a plurality of sets of plates to be pivotally and detachably coupled to the frame member. The universal coupler comprises a plurality of first connecting members located on the frame member and a plurality of second mating connecting members which are located on each plates of the sets of plurality of plates. The workpiece pallet enables an operator to quickly change from a first set of plurality of plates to a second set of plurality of plates if, for example, the shape or size of the workpieces being sewn changes or the predetermined stitch pattern being sewn on the workpiece changes.

13 Claims, 14 Drawing Sheets

U.S. PATENT DOCUMENTS 4,411,208 10/1983 Nishida et al. ..... 112/103
4,455,952 6/1984 Morin et al. .
4,462,320 7/1984 Scholl ..... 112/104
4,479,447 10/1984 Rohr ..... 112/141
4,485,574 12/1984 Bennetot ..... 38/102
4,493,276 1/1985 Sadlh .
4,498,407 2/1985 Landwehr et al. ..... 112/308
4,503,788 3/1985 Giannuzzi et al. .
4,503,789 3/1985 Scholl .
4,574,717 3/1986 Junemann et al. ..... 112/121.15 X
4,587,910 5/1986 Raines .
4,603,647 8/1986 Conley, Jr. et al. .
4,622,907 11/1986 Kimura .
4,639,964 2/1987 Binder ..... 112/121.15 X
4,664,045 5/1987 Landwehr et al. ..... 112/153
4,682,551 7/1987 Toman ..... 112/103
4,694,766 9/1987 Wickers et al. .
4,696,242 9/1987 Scholl et al. .
4,706,583 11/1987 Darbenzio ..... 112/103
4,708,072 11/1987 Frye .
4,763,587 8/1988 Frye .
4,799,438 1/1989 Hinckle .
4,854,251 8/1989 Hiramatsu et al. .
4,870,917 10/1989 Frye .
4,883,006 11/1989 Marii et al. .
4,920,904 5/1990 Frye .
4,989,525 2/1991 Portilla ..... 112/10
5,000,103 3/1991 Beermann ..... 112/121.15 X
5,074,230 12/1991 Morii et al. ..... 112/121

139
134a
152
134
130
133
152
124
132
118
115
112c
162
8
112b
112a
112a
112
120
162
8
112d
138
112e

WORKPIECE PALLET HAVING A DETACHABLE WORKPIECE HOLDER

CROSS REFERENCE TO RELATED APPLICATIONS

This is a continuation-in-part of Ser. No. 07/676,798, filed on Mar. 28, 1991.

BACKGROUND OF THE INVENTION

1. Field of the Invention

This invention relates to a workpiece pallet for use in a programmable sewing machine, and more particularly, it relates to a workpiece pallet having a detachable workpiece holder which can be detachably secured to the workpiece pallet.

2. Description of Related Art

In the sewing industry, a common repetitive function is to sew a predetermined stitch pattern on a label or workpiece of material. To facilitate producing a large number of identical workpieces, a workpiece pallet was used to hold the workpiece while the predetermined stitch pattern was being sewn thereon. The workpiece pallet of the prior art was typically a one-piece construction having a bottom plate and a top plate which was secured directly to the bottom plate. The top and bottom plates would be machined to have an opening corresponding to the size and shape of the workpiece to be sewn to the panel. A workpiece would be placed on the bottom plate and the top plate would be pivoted so as to force the workpiece against the bottom plate, thereby securing the workpiece in the workpiece pallet. Once the workpiece was secured between the top and bottom plates the workpiece pallet would then be moved to a sewing station where the predetermined stitch pattern could be sewn on the workpiece.

Because workpieces usually have different shapes and sizes, each workpiece would require its own workpiece pallet having top and bottom plates which are specifically machined to fit that workpiece. Thus, these workpiece pallets could not accommodate different sized workpieces. It was also necessary to change the workpiece pallet for the same workpiece if it was desired to sew a different predetermined stitch pattern on the workpiece.

While the parent application Ser. No. 07/676,798, shows an excellent design for overcoming the problems mentioned above, even greater advantages are achieved by the apparatus and method of the invention described herein.

SUMMARY OF THE INVENTION

A primary object of this invention is to provide a workpiece pallet which can accommodate multiple workpieces and workpieces having different sizes and shapes.

In one aspect, this invention includes a workpiece pallet for use in a programmable sewing machine having a sewing station, said workpiece pallet comprising: a frame; and a workpiece holder detachably secured to the frame for holding a workpiece in the frame; said workpiece holder being capable of removably securing the workpiece in the frame so that the programmable sewing machine can sew a predetermined stitch pattern on the workpiece when the workpiece pallet is positioned at the sewing station.

In another aspect, this invention includes a workpiece holder for holding a workpiece in a workpiece pallet; said workpiece holder comprising: a template member; securing means for removably securing the workpiece to the template member so that a predetermined stitch pattern can be sewn on the workpiece when the workpiece holder is detachably secured to the workpiece pallet and the workpiece pallet is positioned at a sewing station in a programmable sewing machine.

In yet another aspect, this invention comprises a workpiece pallet for use with a sewing machine having a sewing station said workpiece pallet comprising: a frame member; a locator associated with said frame member for locating a workpiece in said frame member; and pivot means for detachably and pivotally securing a plurality of plates to said frame member so that said plurality of plates can cooperate with said base plate to secure the workpiece in said frame member so that said sewing machine can se the workpiece when the workpiece pallet is positioned at the sewing station.

Another object of this invention is to provide a detachable workpiece holder for removably securing a workpiece in a workpiece pallet so that a predetermined stitch pattern can be sewn on the workpiece.

Another object of this invention is to provide a workpiece pallet which eliminates the need for providing a workpiece pallet for each workpiece having a different shape or size.

Another object of this invention is to provide a workpiece pallet which eliminates the need for providing a workpiece pallet for each workpiece whenever the predetermined stitch pattern to be sewn on the workpiece changes.

Still another object of this invention is to provide a workpiece pallet having a universal coupler which permits a plurality of plates to be easily, quickly, and detachably secured to the workpiece pallet without the use of tools.

Yet another object of this invention is to provide a method which permits an operator to quickly and easily change a workpiece holder in a workpiece pallet, thereby improving the operators efficiency in using the programmable sewing machine.

These objects, and others, may be more readily understood in connection with the following specification, claims and drawings.

DESCRIPTION OF THE PREFERRED EMBODIMENT

Figure 1:
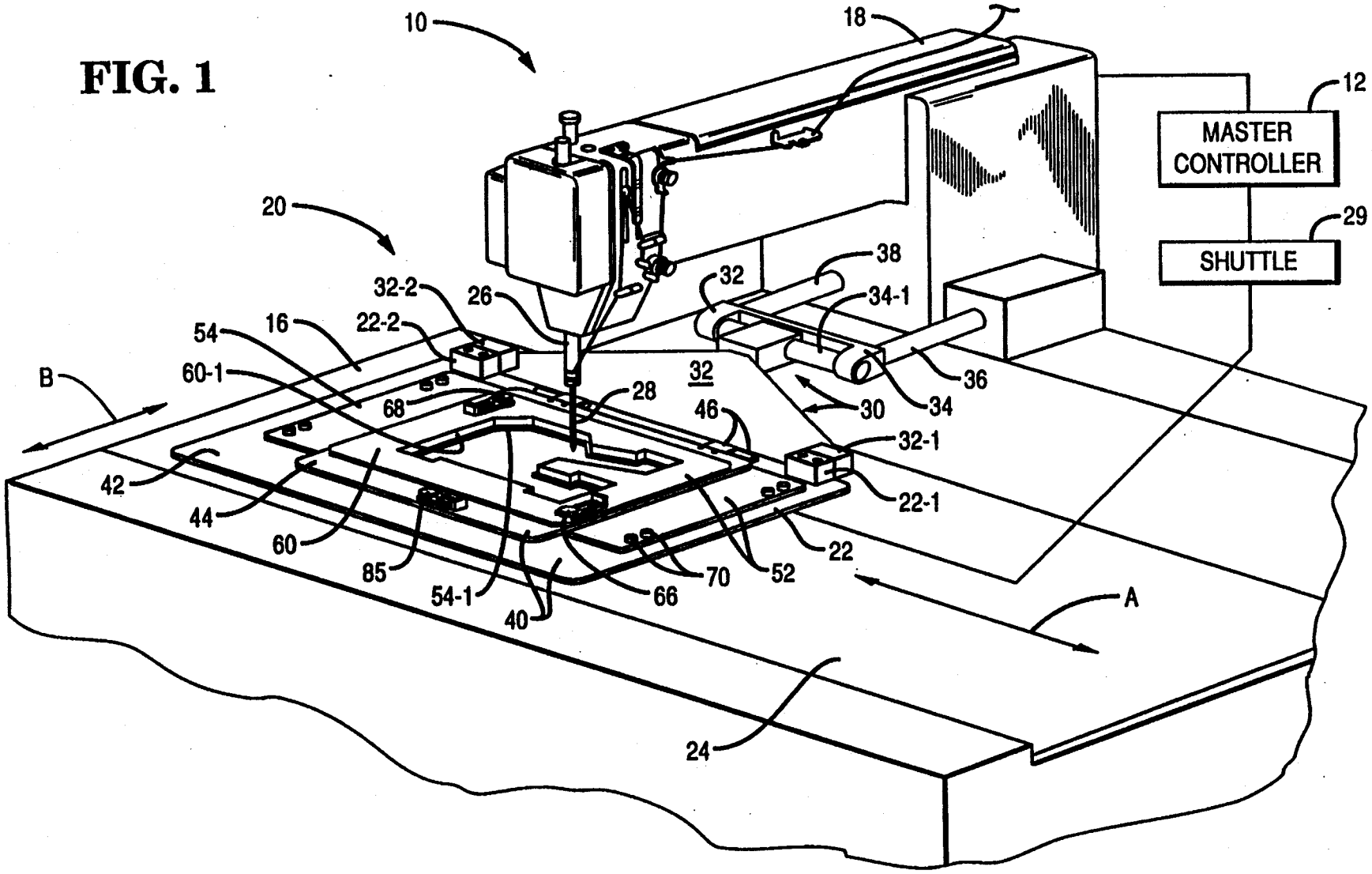
FIG. 1 is a perspective view of a programmable sewing machine in which a preferred embodiment of this invention may be used.
Figure 4:
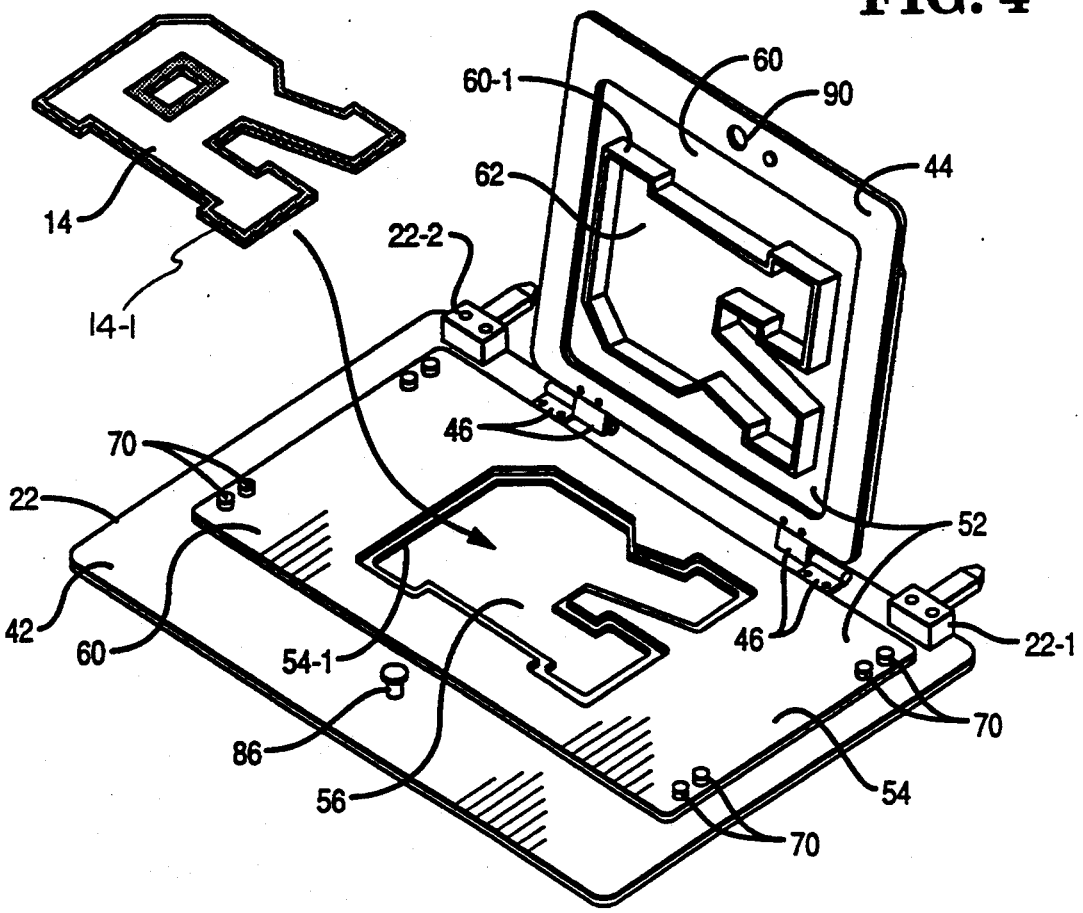
FIG. 4 is a perspective assembled view of the workpiece pallet, showing the first and second frame members in an open position and also showing how a workpiece may be inserted in the workpiece pallet.
Figure 5:
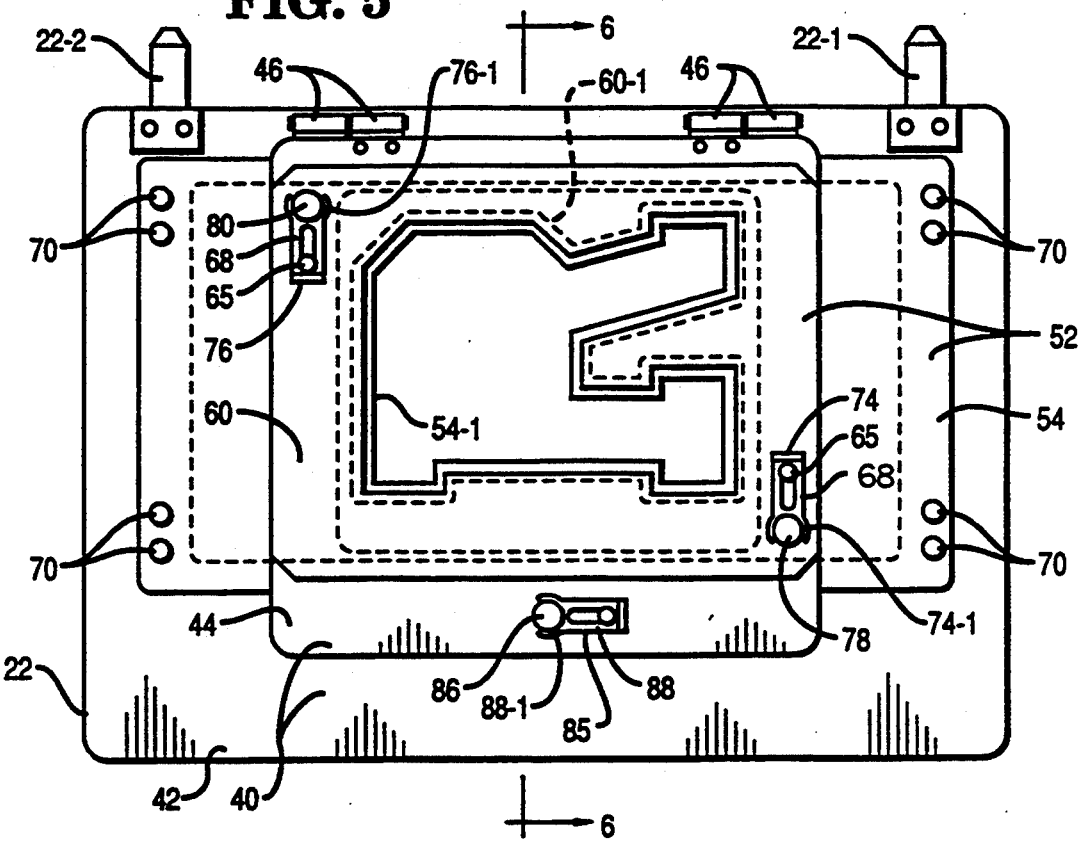
FIG. 5 is a top view of the workpiece pallet, showing details of the means for fastening a first template member to the first frame member and a second template member to the second frame member.

FIG. 1 shows a perspective view of a programmable sewing machine, hereinafter designated as sewing machine 10, in which a preferred embodiment of this invention may be used. The function of the sewing machine 10 is to sew a predetermined stitch pattern (not shown) on a workpiece 14 (FIG. 4), such as a label, according to a computer program (not shown) which is controlled by a master controller 12 (FIG. 1) in the sewing machine 10. In the embodiment being described, the sewing machine 10 may be any programmable sewing machine, including the Brother BAS Series 300 programmable sewing machines, such as the BAS Model 340, which are manufactured by Brother Industries of Japan. The sewing machine 10 comprises a base 16 having a horizontal arm 18 secured thereto. The sewing machine 10 also comprises a sewing station 20 at which the predetermined stitch pattern can be sewn on the workpiece 14 (FIG. 4). The sewing station 20 (FIG. 1) includes a sewing surface 24 which supports a workpiece pallet 22. As best illustrated in FIG. 1, the horizontal arm 18 extends out over the sewing surface 24, and it has a needle holder 26 near the end thereof. The needle holder 26 supports a needle 28 for reciprocating motion in a fixed path that is generally vertical and perpendicular to the sewing surface 24. The needle 28 moves down through a hole (not shown) in a throat plate (not shown) at the bottom of its stroke to transfer a loop of thread to a looptaker (not shown) under the sewing surface 24 at the sewing station 20. The looptaker and needle 28 are both connected to a motor (not shown) which is controlled by the master controller 12 in the sewing machine 10. In the embodiment being described, the sewing machine 10 also includes a shuttle 29 for shuttling the workpiece pallet 22 towards and away from the sewing station 20. The shuttle 29 includes a belt and pulley arrangement (not shown) having means (not shown) for coupling the workpiece pallet 22 to the belt in order to move the workpiece 22 towards and away from the sewing station 20. It is to be noted, however, that the shuttle 29 could be any suitable means capable of shuttling the workpiece pallet 22 toward and away from the sewing station 20. The sewing machine 10 further includes a driver or drive means 30 for moving the workpiece pallet 22 at the sewing station 20 in accordance with the program (not shown) stored in the sewing machine 10 so that the predetermined stitch pattern can be sewn on the workpiece 14. The drive means 20 comprises a pallet support 32 which includes a first receiving member 32-1, and a second receiving member 32-2. The pallet support 32 is coupled to a yoke shaft 34-1 of a yoke 34 which permits the workpiece pallet 22 to move in an X direction, indicated by double arrow A in FIG. 1. The yoke 34 is coupled to a pair of shafts 36 and 38 which can cause the yoke 34 and pallet support 32 to move in a Y direction, indicated by double arrow B in FIG. 1. The shafts 36 and 38 are coupled to a stepper motor (not shown) by various belts, gears and pulleys (not shown) in the sewing machine 10. The pallet support 32 is coupled by various belts, gears and pulleys (not shown) to a second stepper motor (not shown) within the base 16. The stepper motor and second stepper motor are included as part of the drive means 30, and they are both coupled to the master controller 12 in the sewing machine 10. The master controller 12 can selectively energize the stepper motor and second stepper motor individually or simultaneously to move the workpiece pallet 22 in the X or Y directions, thereby permitting the sewing machine 10 to move the workpiece pallet 22 in accordance with the program so that the predetermined stitch pattern can be sewn on the workpiece 14. As best shown in FIGS. 2, 3, 4 and 5, the workpiece pallet 22 comprises a first connector 22-1 and a second connector 22-2 which are received by the first and second receiving members 32-1 and 32-2, thereby securing the workpiece pallet 22 to the drive means 30. It is to be noted that the driver or drive means 30 could be any suitable means which is capable of moving the workpiece pallet 22 in accordance with the program.

Figure 7:
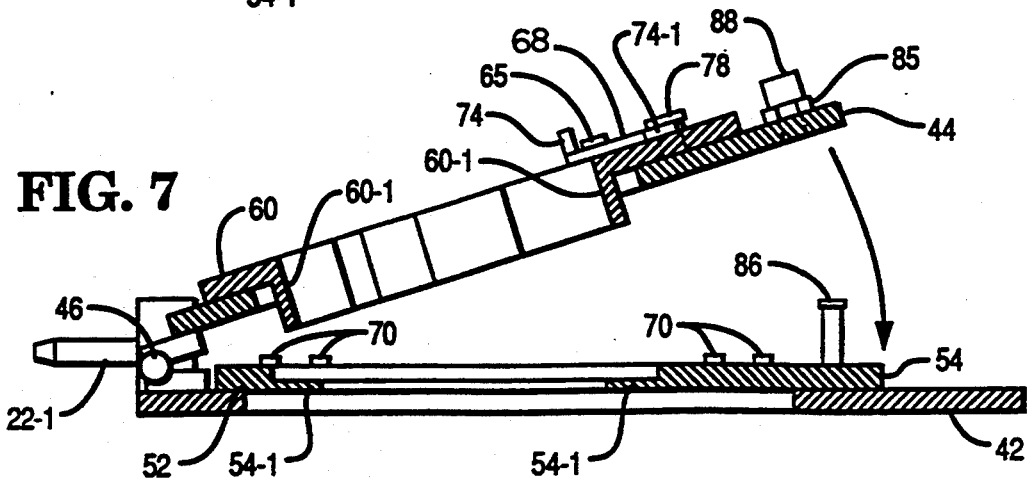
FIG. 7 is a sectional view of the workpiece pallet as shown in FIG. 6, showing the first and second frame members in an open position.

The sewing machine 10 further comprises the workpiece pallet 22 mentioned previously herein. The function of the workpiece pallet 22 is to secure the workpiece 14 while the workpiece 14 is being transported towards and away from the sewing station 20 by the shuttle 29. Another function of the workpiece pallet 22 is to secure the workpiece 14 during the sewing operation when the master controller 12 energizes the drive means 30 to move the workpiece pallet 22 in accordance with the program (not shown) so that the predetermined stitch pattern can be sewn on the workpiece 14. The workpiece pallet 22 includes a frame 40 (FIG. 3) having a first frame member 42 (FIGS. 2, 3 and 4) and a second frame member 44. A pair of hinges 46 couple the second frame member 44 to the first frame member 42 and permit the first and second frame members 42 and 44 to pivot between a closed position (shown in FIG. 3) and an open position (shown in FIGS. 4 and 7). In a preferred embodiment, the first frame member 42 (FIG. 2) is rectangular and defines a generally rectangular aperture 45, and the second frame member 44 is also rectangular and defines a generally rectangular aperture 48.

The workpiece pallet 22 also includes a workpiece holder 52 which is supported by the frame 40. The function of the workpiece holder 52 is to hold the workpiece 14 so that the sewing machine 10 can sew the predetermined stitch pattern to be sewn on the workpiece 14 when the workpiece holder 52 is detachably secured to the workpiece pallet 22 and the workpiece pallet 22 is positioned at the sewing station 20. In the embodiment being described, the workpiece holder 52 comprises a first template member 54 which has an aperture 56 surrounded by a seat 54-1. As best shown in FIG. 4, the workpiece 14 has an outer edge portion 14-1. The seat 54-1 is capable of receiving and supporting the outer edge portion 14-1.

Figure 2:
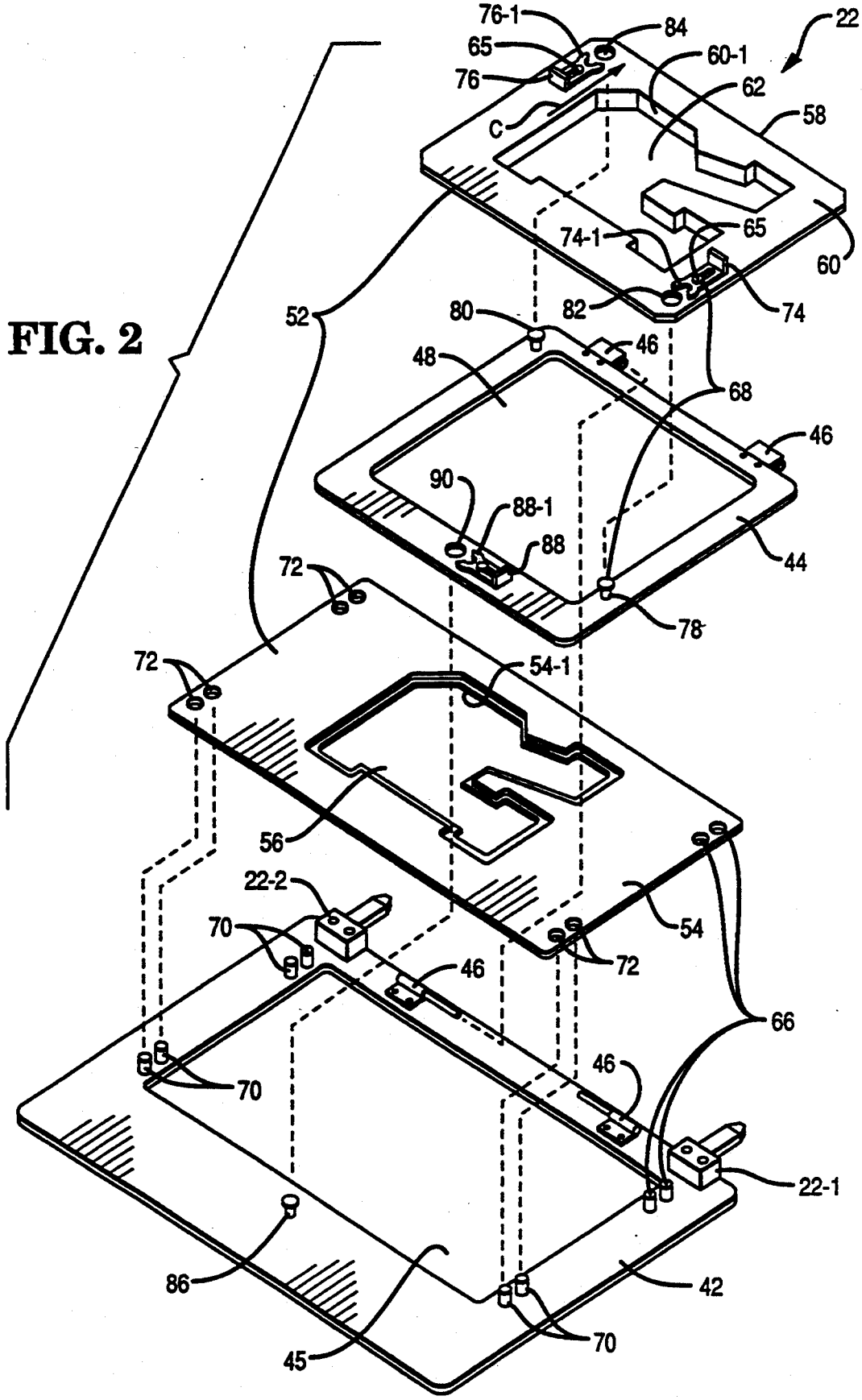
FIG. 2 is a perspective exploded view of a workpiece pallet.
Figure 3:
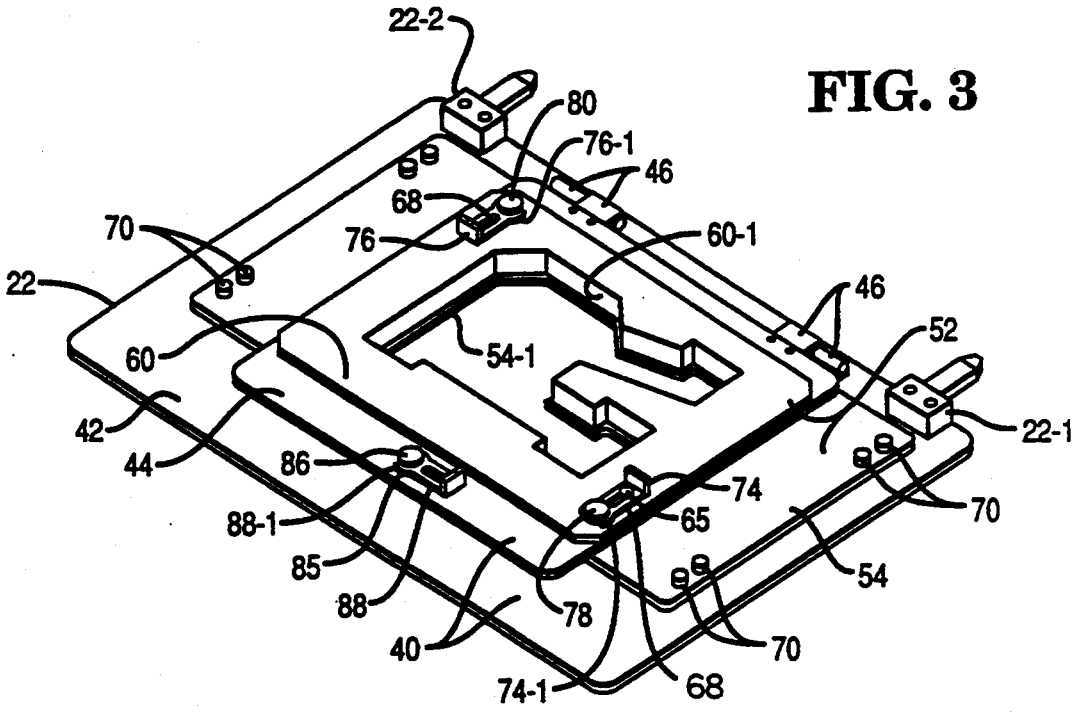
FIG. 3 is a perspective assembled view of the workpiece pallet shown in FIG. 2, showing a first frame member and a second frame member in a closed position.
Figure 6:
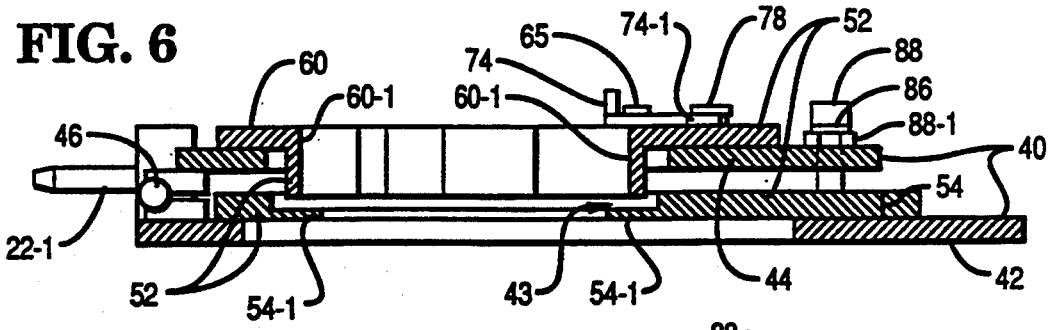
FIG. 6 is a sectional view, taken along the line 6—6 in FIG. 5, showing a flange on the second template member being in operative relationship with a seat in the first template member.

The workpiece holder 52 also includes securing means or means for removably securing the workpiece 14 to the first template member 54. In one embodiment of the invention, the securing means includes a second template member 60 which cooperates with the first template member 54 to secure the workpiece 14 in the workpiece holder 52 when the second template member 60 is placed in operative relationship with the first template member 54. As illustrated in FIG. 2, the second template member 60 has an aperture 62 surrounded by a flange 60-1. It is to be noted that the apertures 56 and 62 generally correspond to the shape of the workpiece 14 and the predetermined stitch pattern to be sewn on the workpiece 14. The shape of the flange 60-1 may change if the shape of the workpiece 14 changes or if it is desired to change the shape of the predetermined stitch pattern. As best illustrated in FIG. 6, the flange 60-1 is capable of forcing the outer edge 14-1 of the workpiece 14 against the seat 54-1 when the first and second frame members 42 and 44 are pivoted to the closed position, thereby securing the workpiece 14 in the workpiece pallet 22. When the first and second frame members 42 and 44 are in the closed position, there is an area 43 between the flange 60-1 and seat 54-1 wherein the outer edge portion 14-1 of the workpiece 14 is "pinched" in order to secure the workpiece 14 in the workpiece holder 52.

Figure 8:
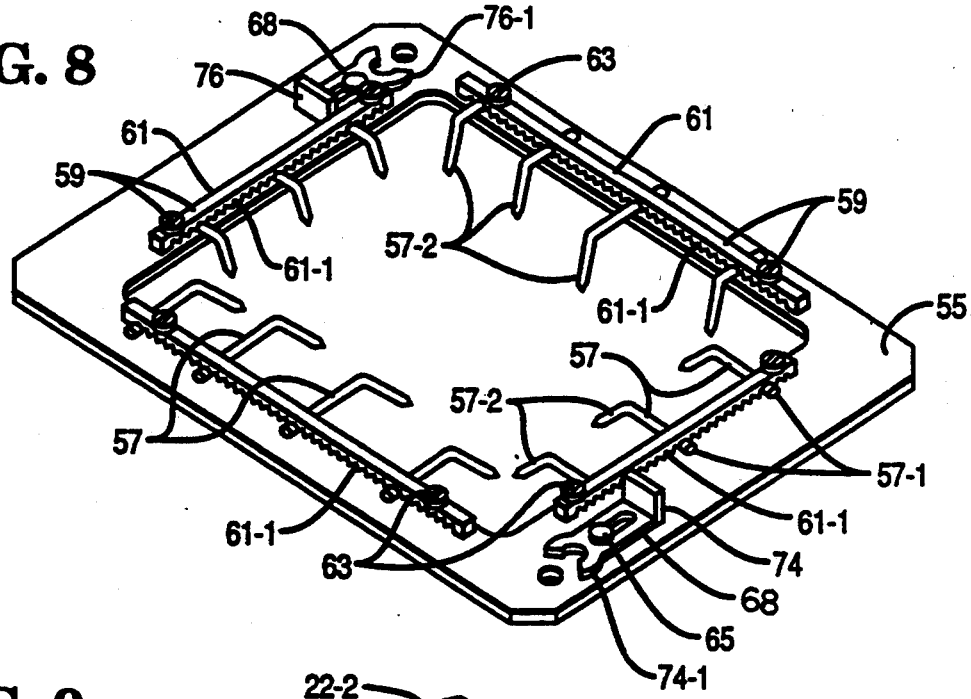
FIG. 8 is a perspective view of a support member which can be used in place of the second template member, showing a plurality of fingers fastened on the support member.
Figure 9:
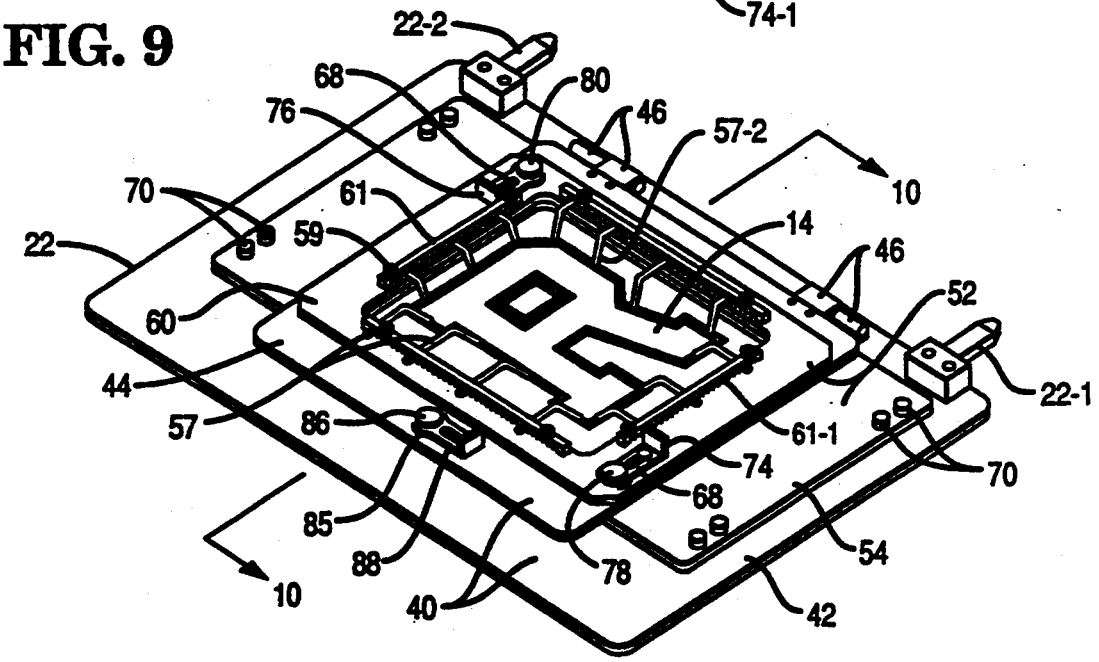
FIG. 9 is a perspective view showing the workpiece pallet with the support member of FIG. 8 mounted thereon.
Figure 10:
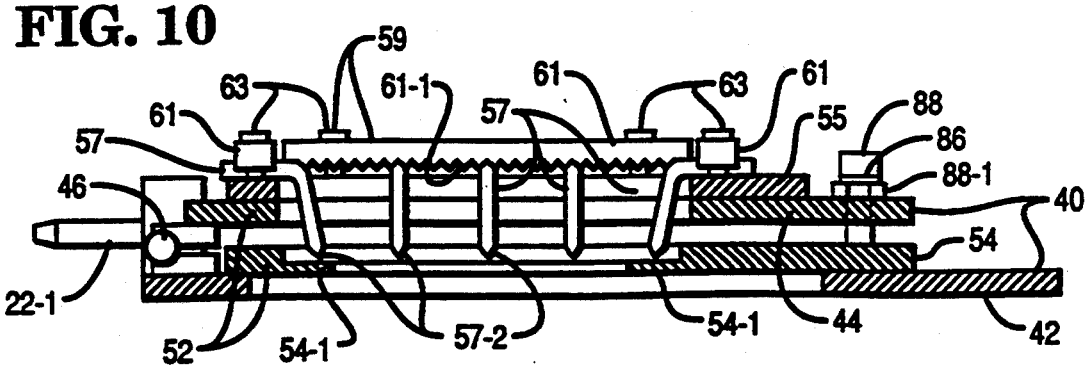
FIG. 10 is a sectional view of the workpiece pallet shown in FIG. 9, taken along the line 10—10 in FIG.

FIGS. 8, 9 and 10 show another embodiment of this invention in which the securing means includes a template or support member 55 which can be used in place of the second template member 60. Those parts of the support member 55 which are identical to the corresponding parts on the second template member 60 are given the same part numbers. The support member 55 has a plurality of fingers 57 each having a first end 57-1 and a second end 57-2. The support member 55 also includes an adjustment means 59 for adjustably securing the plurality of fingers 57 to the support member 55 in order to permit the second ends 57-2 to force the outer edge 14-1 of the workpiece 14 against the seat 54-1 when the first and second frame members 42 and 44 are in a closed position. As best shown in FIGS. 8 and 9, the adjusting means 59 includes a plurality of retaining bars 61 which are secured to the support member 55 by suitable fasteners, such as screws 63. As best shown in FIG. 9, the retaining bars 61 each have a toothed surface 61-1 which facilitates securing the first ends 57-1 against the support member 55. Although the adjusting means 59 is described herein as including the retaining bar 61, it could be any suitable means for adjustably fastening the plurality of fingers 57 against the support member 55. A feature of the adjusting means 59 is that it enables the plurality of fingers 57 to be adjustably secured to the support member 55 so that the position of the second ends 57-2 can be adjusted, for example, in order to accommodate first template members 54 with different shaped seats 54-1. The support member 55 mounts on the second frame member 44 in the same manner as described below for securing the second template member 60 to the second frame member 44.

The workpiece pallet 22 also comprises means for fastening the workpiece holder 52 to the frame 40. The fastening means includes a first fastener 66 for securing the first template member 54 to the first frame member 42 and a second fastener 68 for securing the second template member 60 to the second frame member 44. In the embodiment being described, the first fastener 66 includes a plurality of projections, such as 70, which are located on the first frame member 42. The first template member 54 includes a plurality of apertures, such as 72, which mate with and receive the projections 70. The apertures 72 are aligned with the projections 70 when it is desired to detachably secure or fasten the first template member 54 to the first frame member 42. The apertures 72 can be slip fit onto the projections 70, thereby permitting the first template member 54 to be detachably secured to the first frame member 42.

The second fastener 68 is comprised of a first locking member 74 and a second locking member 76. The first and second locking members 74 and 76 are slidably secured to the second template member 60 by any conventional means, such as by screws or rivets 65. The second fastener 68 further includes a first post member 78 and a second post member 80 which upstand from the second frame member 44, as shown in FIG. 2. The second template member 60 has a first slot 82 and a second slot 84 which are capable of receiving the first and second post members 78 and 80, respectively when it is desired to detachably mount the second template member 60 onto the second frame member 44, the first and second slots 82 and 84 received by the first and second post members 78 and 80. The second locking member 76 has a C-shaped end 76-1 which is slid in the direction of arrow C in FIG. 2 until it is forced or snap fitted into locked engagement with the second post member 80. Likewise, the first locking member 74 has a C-shaped end 74-1 which is forced or snap fitted against the first post member 78 in order to lock the first locking member 74 against the first post member 78. The second template member 60 becomes detachably fastened to the second frame member 44 when the first and second locking members 74 and 76 become locked with the first and second post members 78 and 80. Although not shown, the fastening means described herein could be any suitable means capable of fastening the first and second template members 54 and 60 to the first and second frame members 42 and 44, respectively.

The workpiece pallet 22 further comprises a means for fastening the first frame member 42 and the second frame member 44 in the closed position. This second fastening means includes a third fastener 85 having a third post member 86 located on said first frame member 42 and a third locking member 88 which is located on the second frame member 44. The second frame member 44 includes a third slot 90 which is capable of receiving the third post member 86. The third locking member 88 has a C-shaped end 88-1 which is snap or force fit to lock against the third post member 86 after the second frame member 44 is pivoted from the open position to the closed position. The means for fastening the first and second frame members 42 and 44 together could be any suitable means which is capable of fastening the first and second frame members 42 and 44 together.

A method for sewing the predetermined stitch pattern on the workpiece 14 using the sewing machine 10 will now be described. The first and second template members 54 and 60, which have apertures 56 and 62, respectively, generally correspond to the shape of the workpiece 14, are selected. The first template member 54 is then detachably fastened to the first frame member 42, and the second template member 60 is detachably fastened to the second frame member 44. With the first and second frame members 42 and 44 in the open position (FIGS. 4 and 7), the operator can then "load" the workpiece pallet 22 by placing a workpiece 14 in the seat 54-1 of the first template member 54 so that the outer edge portion 14-1 is supported by the seat 54-1. The second frame member 44 would then be pivoted to the closed position (FIG. 3) where the flange 60-1 of the second template member 60 would force the outer edge portion 14-1 of the workpiece 14 against the seat 54-1, thereby securing the workpiece 14 in the workpiece holder 52. The first and second frame members 42 and 44 would then be locked or fastened in the closed position by sliding the third locking member 88 into locked engagement with the third post member 86, as described previously herein. The master controller 12 may then energize the shuttle 29 to shuttle the workpiece pallet 22 towards the sewing station 20 until the first and second connectors 22-1 and 22-2 become aligned with and received by the first and second receiving members 32-1 and 32-2, respectively. The master controller 12 can then move the workpiece pallet 22 in the X and Y directions in accordance with the program so that the sewing machine 10 sews the predetermined stitch pattern on the workpiece 14. After the sewing operation is completed, the shuttle 29 shuttles the workpiece pallet 22 away from the sewing station 20. The third locking member 88 is then unlocked and the first and second frame members 42 and 44 are pivoted to the open position where the sewn workpiece 14 can be removed.

If it were desired to sew a different predetermined stitch pattern or to sew a new workpiece 14 having a different shape than the workpiece 14 previously being sewn, then the workpiece holder 52 would be dismounted from the frame 40 and a new workpiece holder 52 would then be secured to the frame 40. In this regard, the first template member 54 would be detached or dismounted from the first frame member 42. A new first template member 54 having an aperture 56 corresponding to the shape of the new workpiece 14 would be detachably secured to the first frame member 42. Likewise, the second template member 60 would be dismounted from the second frame member 44, and a new second template member 60 having a second aperture 62 corresponding to the shape of the new workpiece 14 would be fastened to the second frame member 44 in the manner described previously herein. The first and second template members 54 and 60 may then cooperate to secure the new workpieces 14 in the workpiece pallet 22. The workpiece pallet 22 can then be shuttled to the sewing station 20 so that the predetermined stitch pattern can be sewn on the workpiece as described earlier herein. It can be seen that when it is desired to sew a different predetermined stitch pattern or a workpiece 14 having a different shape, the workpiece holder 52 can be changed easily and quickly.

Although not shown, it may be desirable to have two workpiece pallets 22 to facilitate increasing the productivity of an operator. In such an operating environment, an operator could load one workpiece pallet 22 while another workpiece pallet 22 having a workpiece 14 secured therein is located at the sewing station 20 so that the predetermined stitch pattern can be sewn thereon.

Figure 11:
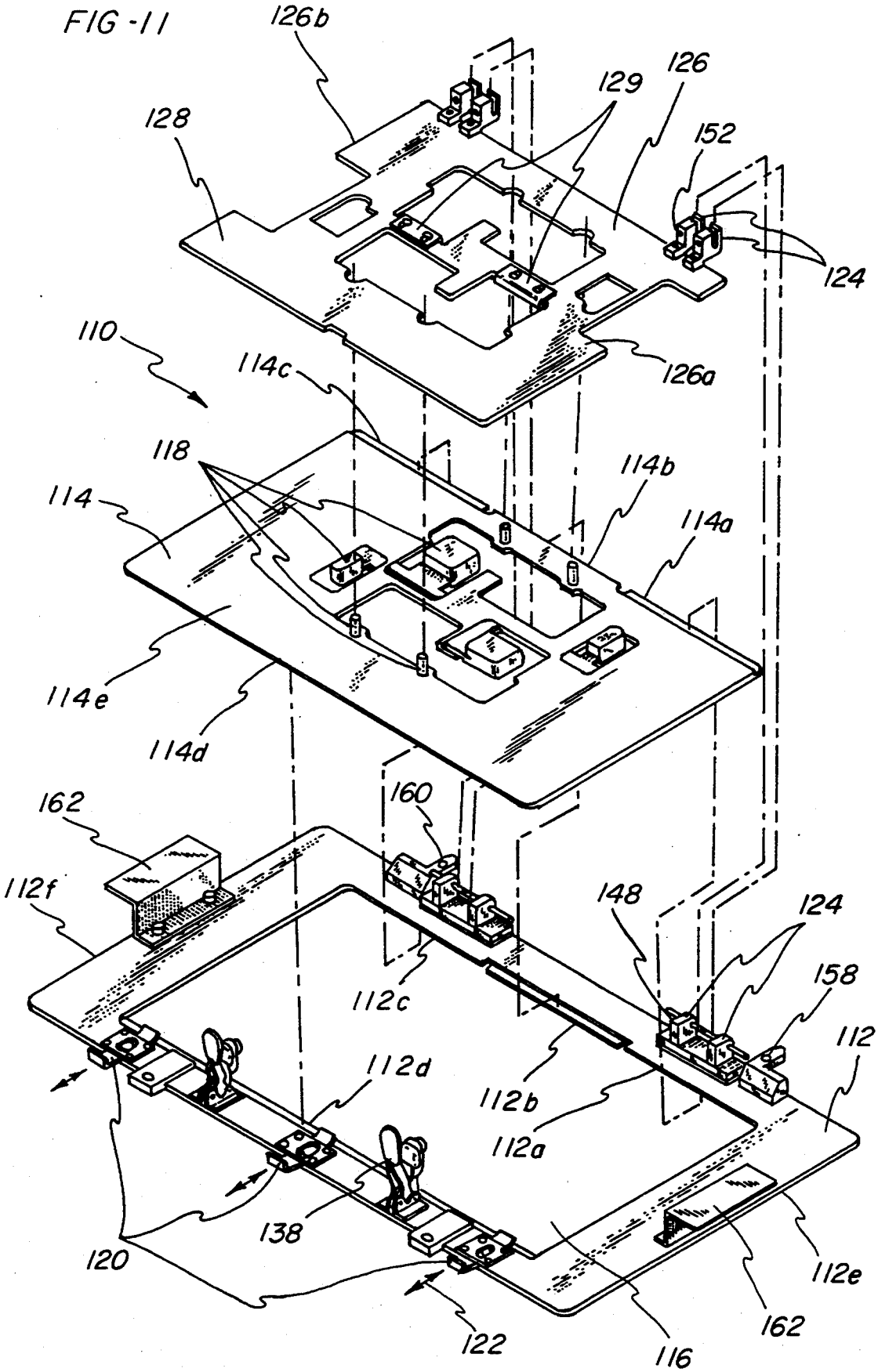
FIG. 11 is an exploded view of another embodiment of this invention, showing a first set of plurality of plates and a pallet frame.
Figure 15:
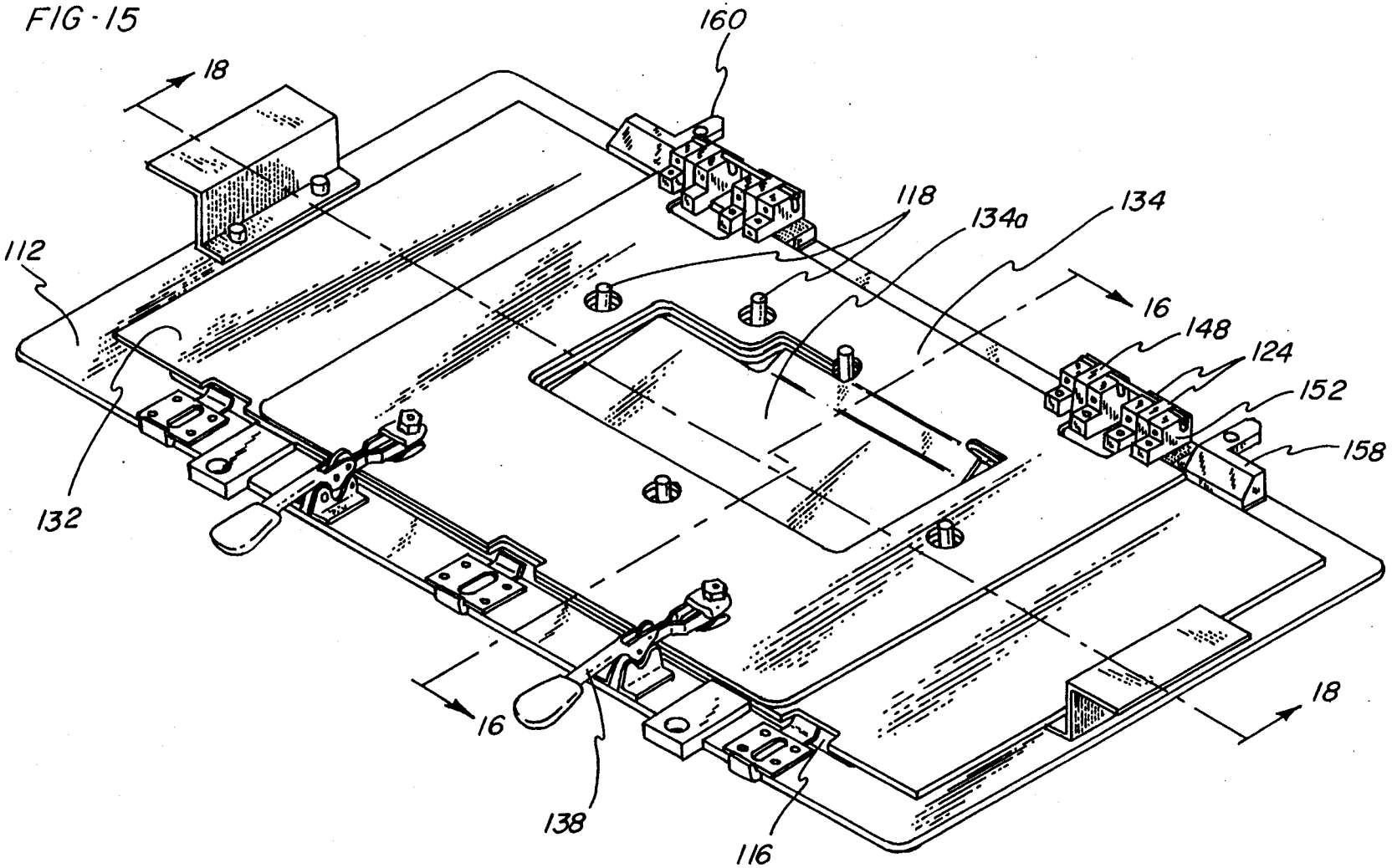
FIG. 15 is an assembled view of the embodiment shown in FIG. 14, showing the second set of plurality of plates in a locked position on the pallet frame.
Figure 16:
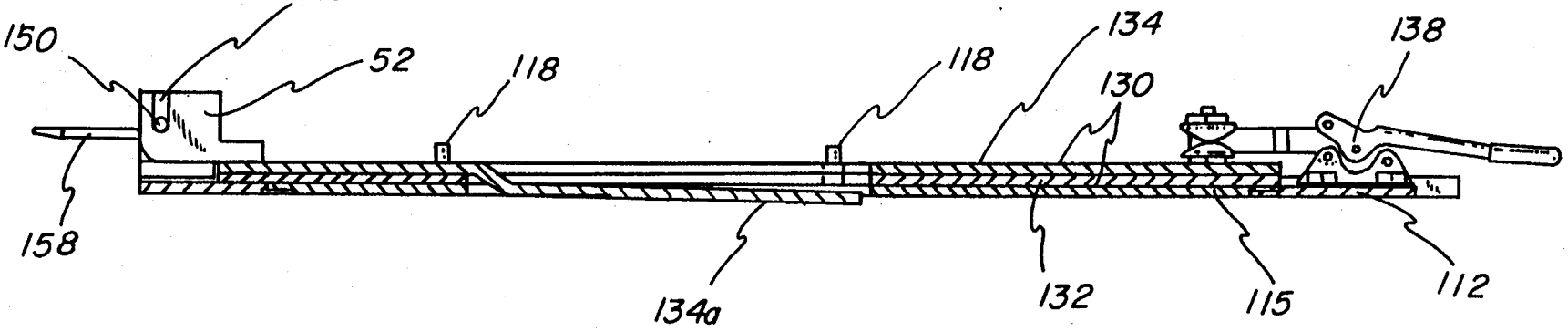
FIG. 16 is a sectional view taken along the line 16—16 in FIG. 15.
Figure 17:
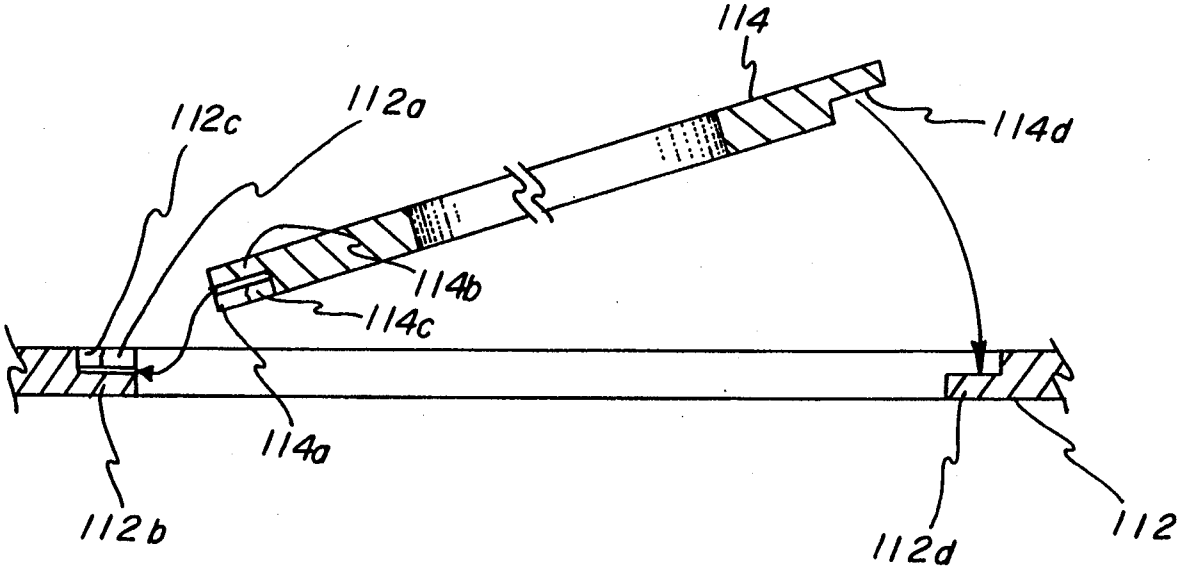
FIG. 17 is a sectional view showing how a base plate can be mounted in the pallet frame.

FIGS. 11–21 show another embodiment of the invention which comprises a workpiece pallet, designated generally as 110 which may also be coupled to the shuttle 29 (FIG. 1) so that the workpiece pallet 110 may be moved towards and away from the sewing station 20 and sewing machine 10. The workpiece pallet 110, shown in FIG. 11, comprises a universal frame member or frame member 112. The workpiece pallet 110 also comprises a locator or base plate 114 associated with the frame member 112 for locating a workpiece in the frame member 112. The base plate 114 comprises a plurality of posts 118 which facilitate locating at least one workpiece in a predetermined position on the base plate 114. As shown in phantom in FIG. 12, the base plate 114 is capable of receiving a plurality of workpieces 117. In the embodiment being described, the locator is shown as a separate base plate 114 which is removably mounted from the universal frame member 112; however, the locator could be integrally formed as part of the frame member 112 if desired. As best illustrated in FIGS. 11 and 17, base plate 114 comprises a plurality of flanges 114*a–d* which cooperate with mating flanges 112*a–d* to support the base plate 114 in aperture 116 of frame member 112.

Workpiece pallet 110 further comprises a lock or locking means for locking base plate 114 to the universal frame member 112. In the embodiment being described, locking means may comprise a plurality of sliding latches 120 which can slide in the direction of double arrow 122 in FIG. 11. After the base plate 114 has been mounted in aperture 116 to universal frame member 112, the sliding latches 120 may be slid towards aperture 116 so that they engage in upper surface 114*e* of flange 114*d*, thereby locking base plate 114 in aperture 116 of frame member 112. Although the lock and locking means has been shown herein as comprising a plurality of sliding latches 120, it could comprise any suitable means for locking base plate 114 to frame member 112. For example, locking means could include another type of fastener, such as a screw or pivotable latch (not shown).

The workpiece pallet 110 also comprises a universal coupler or pivot means for detachably, hingably and pivotally securing a plurality of plates, such as plate 126 in FIG. 11, lower plate 132 (FIG. 13), and upper plate 134 to the frame member 112. The universal coupler or pivot means 124 enables the plurality of plates to be detachably and pivotally coupled to the frame member 112 in cooperative relationship with the base plate 114. This enables the workpiece pallet 110 to receive and secure the workpiece in the frame member 112 so that the sewing machine 10 (FIG. 1) can sew the workpiece when the workpiece pallet 110 is positioned at the sewing station 20.

Figure 12:
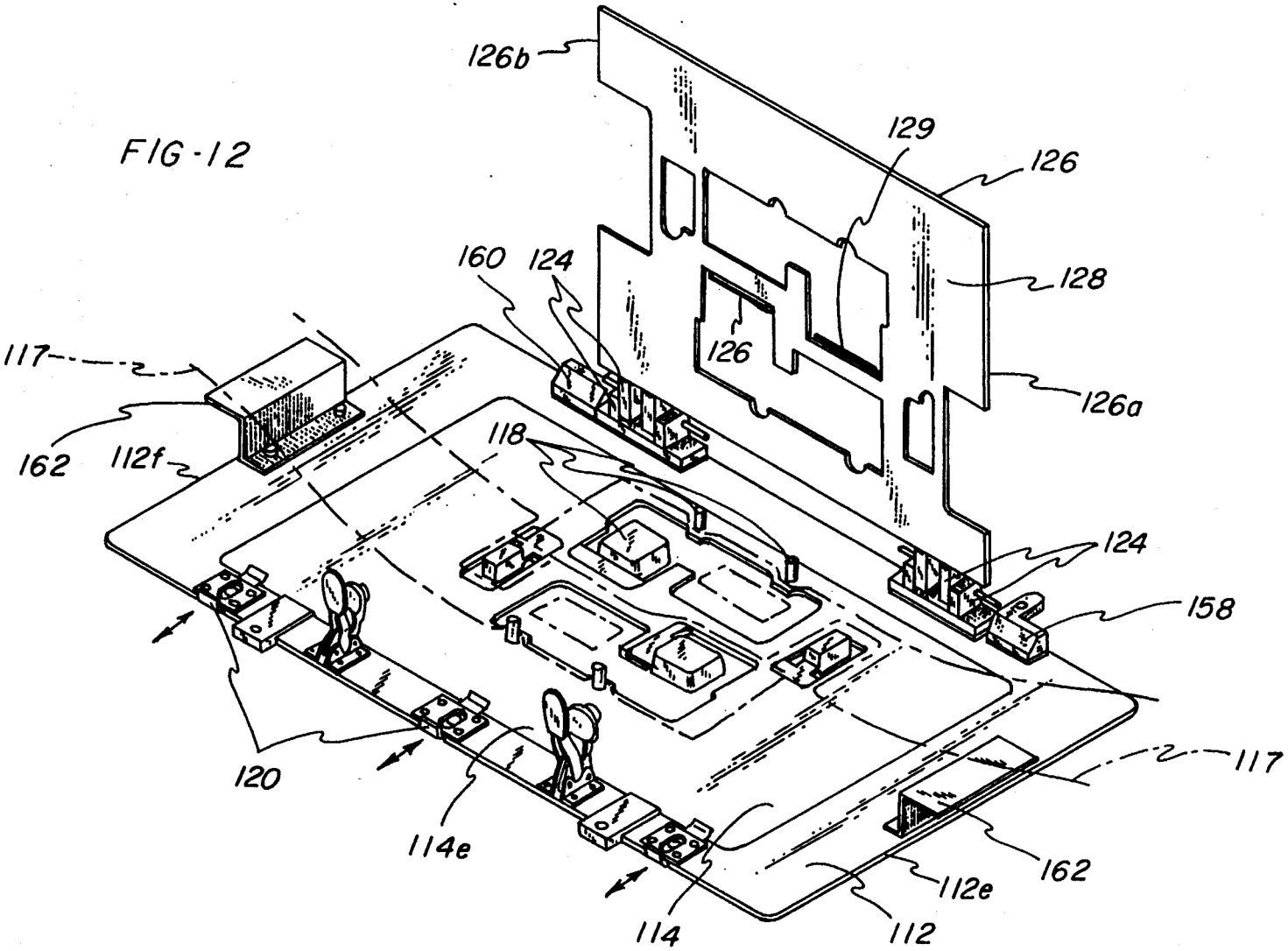
FIG. 12 is an assembled view of the embodiment shown in FIG. 11.
Figure 13:
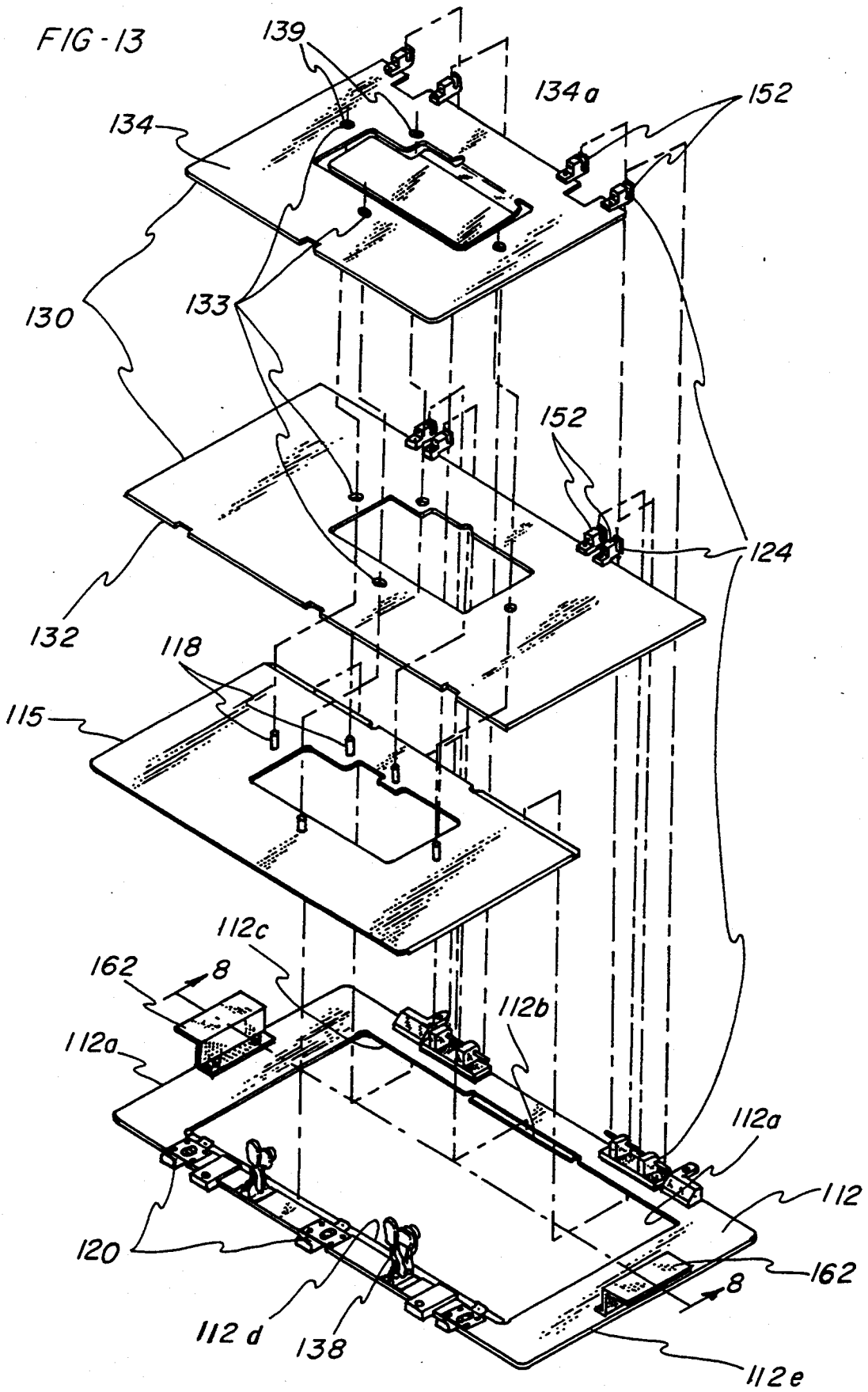
FIG. 13 is an exploded view similar to that of FIG. 11, showing a second set of plurality of plates which can be mounted on the pallet frame.
Figure 14:
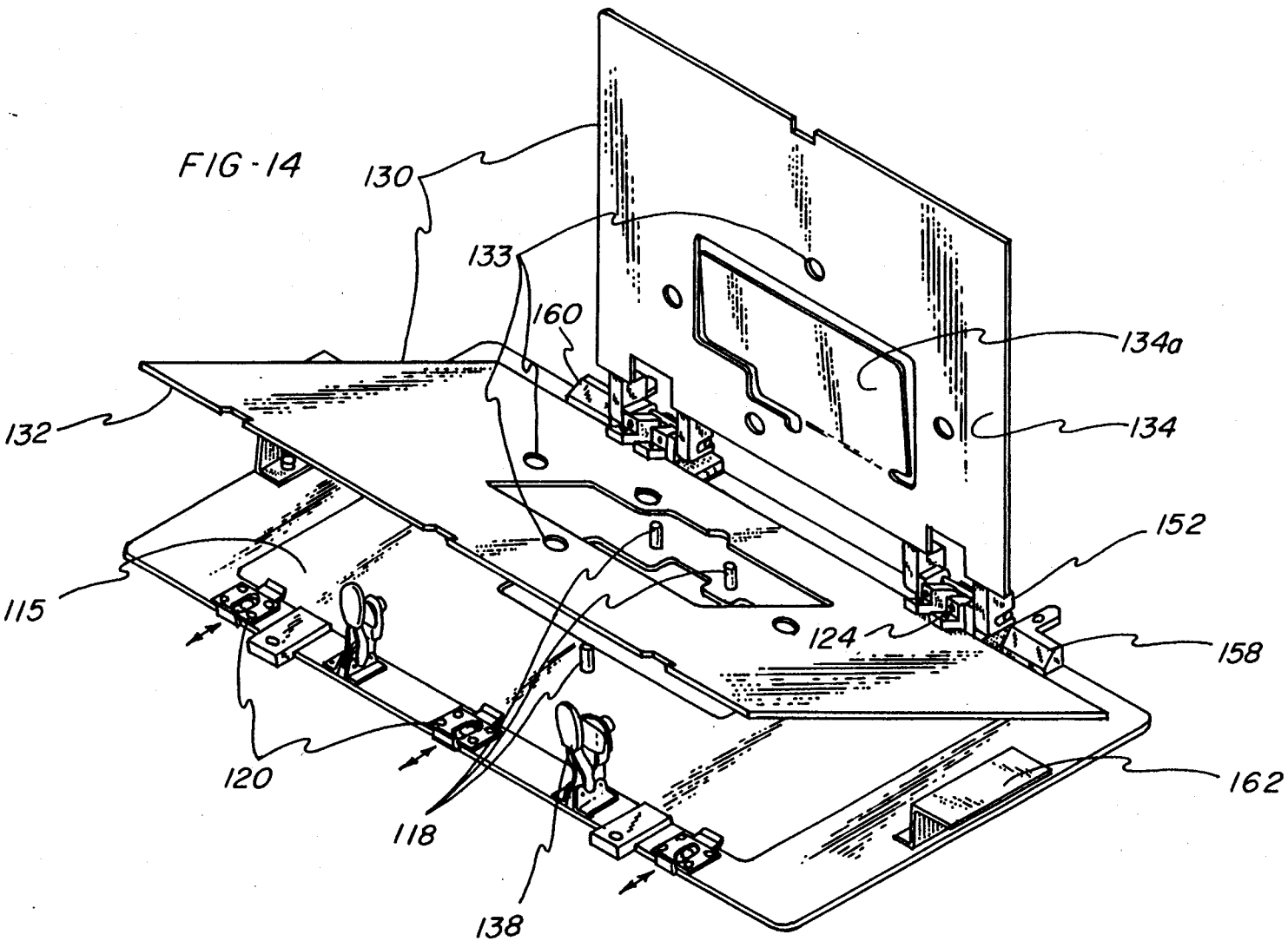
FIG. 14 is an assembled view of the workpiece pallet shown in FIG. 13.

Universal coupler or pivot means 124 enables workpiece pallet 110 to be able to receive a plurality of different sets of plates, with each set of plates corresponding to either a different workpiece or same workpiece, but a different predetermined stitch pattern. It should also be noted that different sets of plates may be provided for the same workpiece if, for example, it was desired to sew a different predetermined stitch pattern on the workpiece. The plurality of plates may be comprised of at least a first set of plates 128 (FIG. 11) and a second set of plates 130 (FIG. 13), where the first set of plates 128 is comprised of a mingle plate 126 and the second set of plates 130 is comprised of the lower plate 132 and the upper plate 134. It is to be noted that plate 126 comprises adjustable locators 129 which may be adjusted to facilitate locating a workpiece between base plate 114 and plate 126. Thus, in the embodiment being described, the first and second sets of plates 128 and 130 are comprised of one and two plates, respectively. As illustrated in FIGS. 11 and 12, the plate 126 of the first set of plates 128 has an associated base plate 114. Likewise, the lower and upper plates 132 and 134 (FIGS. 13 and 14) of the second set of plates 130 has an associated base plate 115. The function and operation of the base plate 115 is identical to the base plate 114 except that it is designed to receive a workpiece (not shown) having a shape which is different from the workpieces received on base plate 114.

As best illustrated in FIGS. 11–16 and 21, the workpiece pallet 110 also comprises a second lock or locking means for retaining first and second sets of plates 128 and 130 in a locked position on the frame member 112. In the embodiment being described, second locking means comprises a pivotal latch 138 having a handle end **138*a* and an engaging end 138*b*. It is to be noted that engaging end 138*b* comprises an adjustable engaging pad 140. The adjustable engaging pad 140 comprises a nut 142 which may be adjustably tightened so that the engaging pad 140 may be adjusted in the directions of double arrow 144. The nut 142 may also be adjusted so that the engaging pad 140 can be adjusted in the direction of double arrow 145, this enables the pivotal locking latch 138** to accommodate a plurality of different sets of plates and also to accommodate plates of varying thicknesses.

Figure 18:
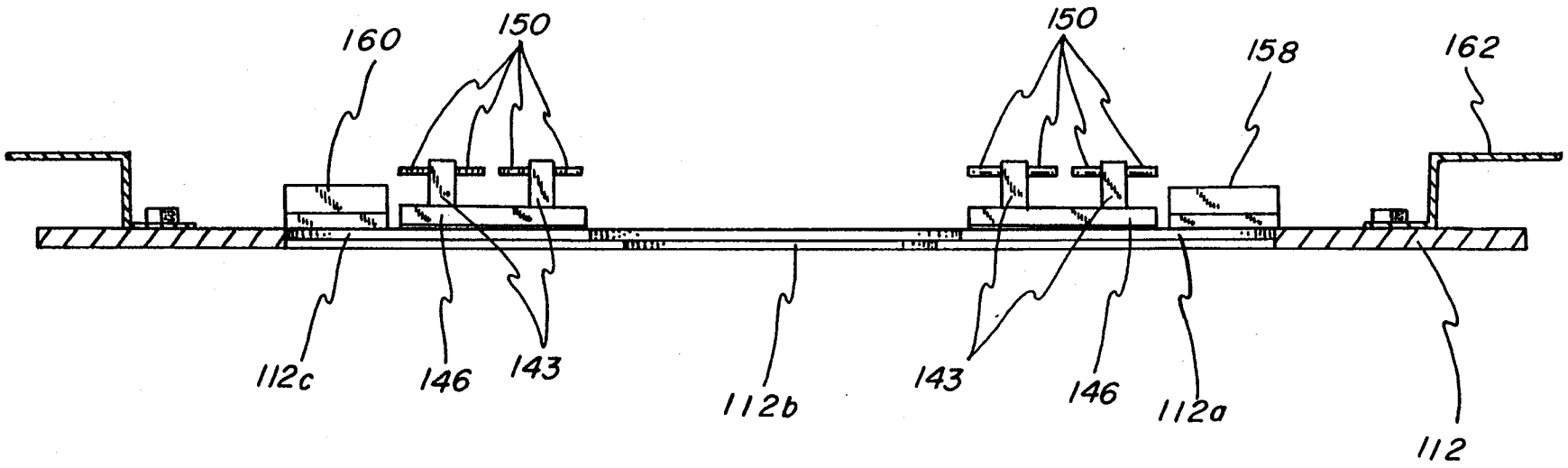
FIG. 18 is another sectional view taken along the line 18—18 in FIG. 15, showing details of a first connecting member.
Figure 19:
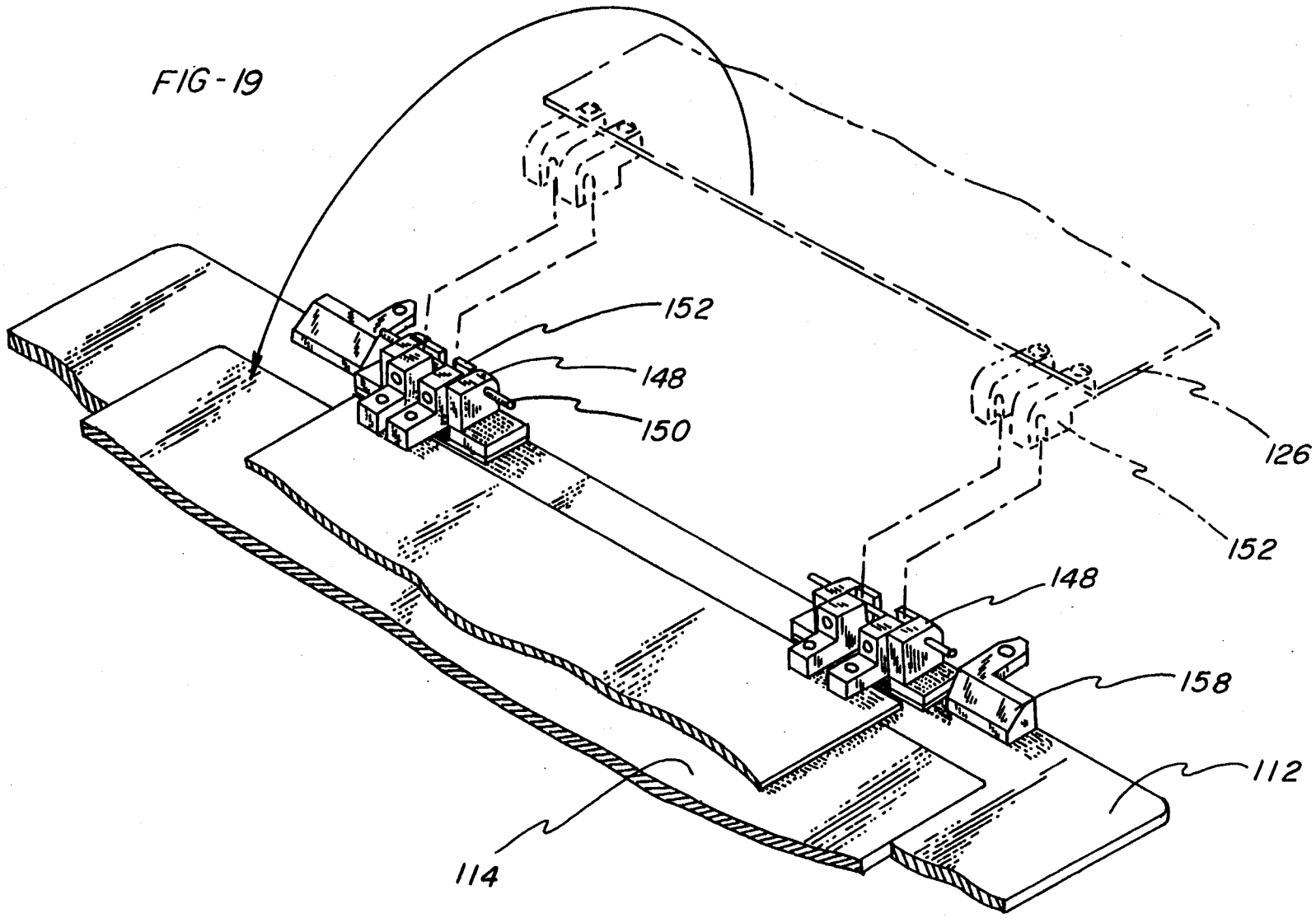
FIG. 19 is a fragmentary view showing flanges on the base plate and complementary flanges on the pallet frame.
Figure 21:
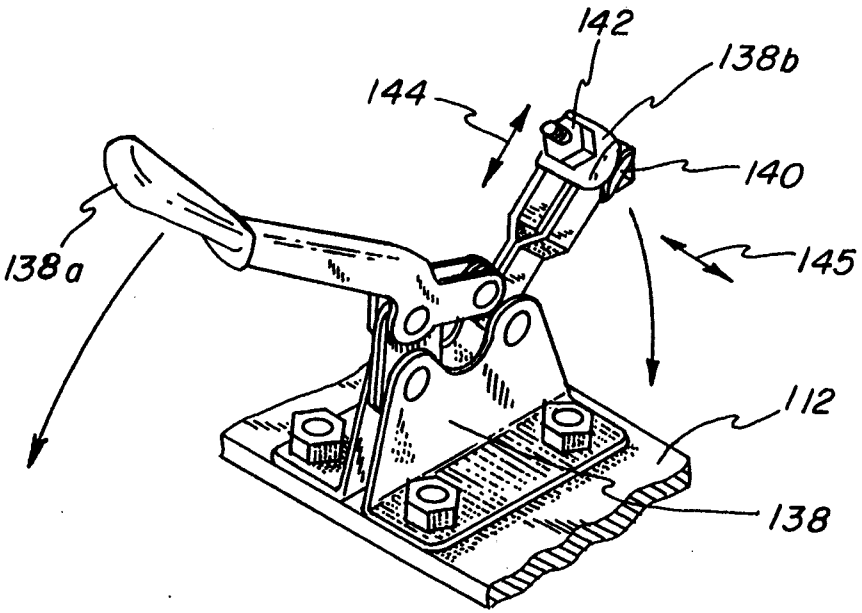
FIG. 21 is a sectional view of a portion of the pallet frame showing a pivotal latch for securing the plurality of sets of workpieces in a locked position on the pallet frame.

The universal coupler or pivot means comprises a pair of first connecting members 146 which are mounted on frame member 112 by conventional means, such as screws, a weld or brace. As best shown in FIG. 18, the first connecting member 146 comprises a plurality of posts 148 which lie in a plane which is generally perpendicular to the plane of the frame member 112. Each of the posts 148 comprise a plurality of pins 150 which, in the embodiment being described, are coaxial and which are generally parallel to the plane of the frame member 112.

Figure 20:
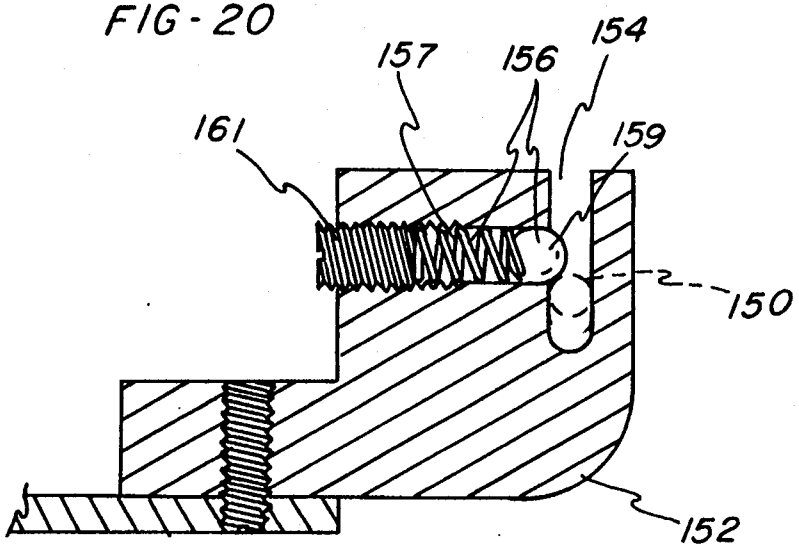
FIG. 20 is a sectional view of a second connecting member located on each of the plates.

The universal coupler or pivot means also comprises a plurality of second connecting members 152 which are located on the plate 128, lower plate 132 and upper plate 134. The second connecting member 152 mates with the first connecting member 146 to permit each of the plurality of plates to be pivotally, hingably and detachably secured to the frame member 112. As best illustrated in FIGS. 11, 13, 19 and 20, the second connecting member 152 become mounted or "snapped" onto pins 150. As shown in FIG. 20, the second connecting member 152 comprises detent means for engaging at least one of the plurality of pins 150 to enable the second connecting member 152 to be pivotally and detachably secured to the first connecting member 146 such that the first and second sets of plates 128 and 130 may pivot about the axis of the pins 150. While the embodiments being shown and described herein show each plate having two pairs of second connecting members 152, it is possible to eliminate one of the second connecting members 152 from each pair. It is to be noted that the second connecting member 152 comprises a slot 154 (FIG. 20) for receiving at least one of the pins 150. As best shown in FIG. 20, detent means comprises a spring loaded detent 156 having a spring 157, ball 159 and screw 161 which may be adjusted to vary the force with which the ball 159 is biased towards slot 154.

The frame member 112 also comprises a first shuttle connector 158 (FIG. 11) and a second shuttle connector 160 which may be received by the first and second receiving members 32-1 and 32-2 of the pallet support 32 of drive means 30. In addition, workpiece pallet 110 also comprises a plurality of handles 162 which may be used to manually handle the workpiece pallet 110. The method of operation and assembly of workpiece pallet 110 will now be described.

The base plate 114 is mounted in frame member 112 by maneuvering flanges **114*a–c* into engagement with flanges 112*a–c* of frame member 112 until flange 114*d* engages flange 112*d*, as best illustrated in FIG. 17. After the base plate 114 is mounted in aperture 116 of frame member 112, the sliding latches 120 can be slid into a locked position such that the base plate 114 becomes locked in aperture 116 of frame member 112, as best shown in FIG. 12**.

In the embodiment being described, either the first set of plates 128 or second set of plates 130 are selected depending upon the workpiece to be sewn. After the first or second set of plurality of plates is selected, the appropriate base plate 114 or 115 associated with the selected set of plurality of plates is selected and mounted in aperture 116 of frame member 112. Assuming the first set of plates 128 is selected, the base plate 114 would then be mounted in frame member 112. The first set of plates 128 is then positioned such that the slots 154 (FIG. 20) of the second connecting member 152 are aligned with the appropriate pins 150 of the first connecting member 146, as shown in phantom in FIG. 19. In the embodiment being described, it is preferable to position the pins 150 in the slots 154 when the plate 128 is in the open position shown in FIG. 19. The slots 154 may then be forced over the pins 150 towards frame member 112 until the pins 150 are retained in the slots 154 by detent means associated with each slot 154, thereby causing the plate 126 of the first set of plates 128 to be detachably and pivotally secured to the frame member 112 in operative relationship with the base plate 114.

After the plate 126 of the first set of plates 128 is pivotally and detachably mounted onto frame member 112, one or more workpieces 117 may be loaded onto the base plate 112, as shown in phantom in FIG. 12. The plate 126 is then pivoted from the open position shown in FIG. 12 to a closed position such that the workpieces 117 are sandwiched between the plate 126 and base plate 114. The pivotal latches 138 may then be pivoted to a locked position such that the plate 126 becomes locked against base plate 114, with the workpieces 117 being clamped therebetween.

The shuttle 29 may then maneuver the workpiece pallet 110 to sewing station 20. The workpiece pallet 110 is then maneuvered until first and second shuttle connectors 158 and 160 engage and are received by the first and second receiving members 32-1 and 32-2 (FIG. 1), respectively, of drive means 30. The sewing machine 10 may then sew a predetermined stitch pattern on the workpieces.

If it were desired to sew a different workpiece or workpieces, (for example, with the second set of plates 130) then the plate 126 would be unlocked and removed from the frame member 112. The base plate 114 would also be unlocked and removed. The base plate 115 would then be mounted in aperture 116 of frame member 112. After base plate 115 is locked into position in frame member 112, the lower plate 132 and upper plate 134 of the second set of plates 130 would then be mounted onto frame member 112 using the universal coupler or pivot means 124. The second set of plates may then be pivoted from the open position, shown in FIG. 14, to the closed position shown in FIGS. 15 and 16. While in the open position shown in FIG. 14, a first workpiece (not shown) may be positioned and located on base plate 115 and the lower plate 132 pivoted to secure the workpiece between base plate 115 and lower plate 132. A second workpiece (not shown) may then be positioned on lower plate 132 and then the upper plate 134 pivoted to a closed position such that the second workpiece is secured between the lower plate 132 and upper plate 134. The pivotal latches 138 may then be pivoted to a locked position shown in FIGS. 15 and 16, such that the first and second workpieces are firmly secured in the workpiece pallet 110.

It is to be noted that the posts 118 project through the lower and upper plates 132 and 134, respectively, which facilitate locating the second workpiece on the lower plate 132. In this regard, the lower and upper plates 132 and 134 each comprise apertures 133 for receiving posts 118. The posts 118 project through the lower and upper plates 132 and 134, as best shown in FIG. 15. Thus, when the lower plate 132 is in the closed position, the posts 118 may also be used to locate a workpiece on the lower plate 132. Once a workpiece is located on base plate 115 and another workpiece is located on lower plate 132, the upper plate 134 may be pivoted to the close position (FIGS. 15 and 16) so that the presser portion **134*a* of the upper plate 134 may firmly secure the second workpiece against the first workpiece. As best illustrated in FIG. 16, a presser portion 134*a* is biased towards aperture 116 of frame member 112 when it is in the close position shown in FIG. 16. This facilitates forcing an inner portion of the second workpiece located on the lower plate. 132 against an inner portion of the first workpiece located on the base plate 115**.

It is to be noted that the universal coupler or pivot means 124 enables frame member 112 of workpiece pallet 110 to be able to receive a plurality of different sets of plates. Note also that the design of the frame member 112 also permits the base plates 114 and 115 to be easily substituted or even replaced by another base plate if desired. Although the embodiments being shown and described herein show the first set of plates and second set of plates 128 and 130, respectively, as comprising a one plate 126 and two plates 132 and 134, respectively, it should be appreciated that the universal coupler enables the frame member 112 to be able to accommodate a plurality of different sets of plates, where each set comprises one or more plates. In addition, frame member 112 could have first connecting members 146 located on either end **112*e* or 112*f* of frame member 112, with mating second connecting members 152 would be located on their ends (such as ends 126*a* and 126*b* of plate 126). This would enable the workpiece pallet to receive other layers of plates 112** if desired.

Advantageously, the workpiece pallet 110 may be used to sew a single workpiece, to sew multiple workpieces side by side, as shown in FIG. 12, or to sew a second workpiece onto a first workpiece, as described above. This workpiece pallet is also advantageous because it comprises a single workpiece pallet 110 which enables a plurality of different sets of plates and base plates to be detachably and pivotally secured in a frame member 112 of the workpiece pallet 110 using a universal coupler. This enables an operator to easily and quickly change from one set of plates to another set of plates comprising one or more plates. In addition, the base plates 114 and 115 may be easily and quickly detachably removed from frame member 112. The design of the present invention eliminates or reduces the need for an operator to carry an inventory of different workpieces pallets, that is, one for each different workpiece.

Various changes or modifications in the invention described may occur to those skilled in the art without departing from the spirit or scope of the invention. The above description of the invention is intended to be illustrative and not limiting, and it is not intended that the invention be restricted thereto but that it be limited only by the true spirit and scope of the appended claims.

What is claimed is:

1. A workpiece pallet for use with a sewing machine having a sewing station, said workpiece pallet comprising:

a frame member;

a locator associated with said frame member for locating a workpiece in said frame member; and pivot means for detachably and pivotally securing either one of a plurality of sets a plurality of plates to said frame member to secure the workpiece in said frame member so that said sewing machine can sew the workpiece when the workpiece pallet is positioned at the sewing station;

said plurality of sets of plates being comprised of at least a first set of plates and a second set of plates;

the first and second sets of plates being comprised of one and two plates, respectively.

2. A workpiece pallet for use with a sewing machine having a sewing station, said workpiece pallet comprising:

a frame member;

a locator associated with said frame member for locating a workpiece in said frame member; and pivot means for detachably and pivotally securing a plurality of plates to said frame member so that said plurality of plates can cooperate with said locator to secure the workpiece in said frame member so that said sewing machine can sew the workpiece when the workpiece pallet is positioned at the sewing station;

said pivot means comprising a first connecting member located on said frame member and a second connecting member located on each of said plates, said second connecting member pivotally and detachably mating with said first connecting member to permit each of said plurality of plates to be pivotally and detachably secured to said frame member;

said frame member lying in a plane, said first connecting member comprising at least one pin and said second connecting member having detent means for engaging said at least one pin to enable said second connecting member to be pivotally and detachably secured to the first connecting member such that said plurality of plates may pivot about the axis of said pins; and said detent means comprising a spring-loaded detent.

3. A workpiece pallet for use with a sewing machine having a sewing station, said workpiece pallet comprising:

a frame member;

a locator associated with said frame member for locating a workpiece in said frame member; and pivot means for detachably and pivotally securing a plurality of plates to said frame member to secure the workpiece in said frame member so that said sewing machine can sew the workpiece when the workpiece pallet is positioned at the sewing station;

said workpiece pallet further comprising locking means for retaining said plurality of plates in a locked position on said frame member;

said locator comprising a base plate which is removably secured to said frame;

said workpiece pallet further comprising second locking means for locking said base plate to said frame member.

4. The workpiece pallet as recited in claim 3 wherein said second locking means comprises at least one slidable latch.

5. A method for interchangeably and pivotally coupling a plurality of sets of plates to a frame member of a workpiece pallet, said method comprising the steps of:

(a) selecting one of said sets of said plurality of sets of plates to mount on said frame member;

(b) pivotally and detachably mounting said one of said sets of said plurality of plates to said frame member with a universal coupler;

(c) removing said one of said sets of said plurality of plates selected in step (a); and (d) repeating steps (a) and (b) for another set of said plurality of plates.

6. A workpiece pallet which is capable of detachably and interchangeably receiving at least one of a plurality of sets of plates, said workpiece pallet comprising:

a frame member, said frame member having receiving means for receiving a locator plate for registering a workpiece in a predetermined position in said frame member; and a universal coupler for permitting said frame member to pivotally and interchangeably receive at least one of said plurality of sets of plates;

said receiving means comprising a plurality of flange members, said workpiece pallet further comprising locking means for locking said locator plate in said workpiece pallet.

7. The workpiece pallet as recited in claim 6 wherein said second locking means comprises a plurality of sliding latches.

8. A workpiece pallet which is capable of detachably and interchangeably receiving a plurality of sets of plates, said workpiece pallet comprising:

a frame member, said frame member having receiving means for receiving a locator plate for registering a workpiece in a predetermined position in said frame member; and a universal coupling for permitting said frame member to pivotally and interchangeably receive a plurality of preselected sets of said plurality of plates;

said universal coupling comprising a first connecting member for mounting on said frame member and a second connecting member for mounting on each of said plurality sets of plates, said first and second connecting members cooperating to permit at least one of said plurality of sets of plates to be pivotally and interchangeably mounted on said frame member such that said at least one of said plurality of sets of plates becomes operatively aligned with said locator plate so that said workpiece can be clamped in said workpiece pallet;

said frame member lying in a plane and said first connecting member comprises at least one pin having an axis which is generally parallel to said plane; and said second connecting member comprising at least one bracket member having detent means for engaging said at least one pin in order to interchangeably and pivotally secure said at least one of said plurality of sets of plates to said frame member;

said at least one bracket member comprising a slot and said detent means comprising a spring loaded detent which is operatively associated with said slot.

9. A sewing machine having a sewing surface and a sewing station at which a predetermined stitch pattern may be sewn on a workpiece, said sewing machine comprising:

a workpiece pallet for receiving a workpiece;

a shuttle for moving the workpiece pallet about the sewing surface at the sewing station so that a predetermined stitch pattern may be sewn on the workpiece; and a master controller for energizing the shuttle;

said workpiece pallet comprising:

mounting means for mounting the workpiece pallet to said shuttle;

a frame member, said frame member having receiving means for receiving a locator plate for registering a workpiece in a fixed position in said frame member; and a universal coupler for permitting said frame member to be capable of pivotally and interchangeably receiving a plurality of preselected sets of said plurality of plates;

said receiving means, comprising a plurality of flange members, said workpiece pallet further comprising a plurality of sliding latches for locking said locator plate in said-workpiece pallet.

10. A sewing machine having a sewing surface and a sewing station at which a predetermined stitch pattern may be sewn on a workpiece, said sewing machine comprising:

a workpiece pallet for receiving a workpiece;

a shuttle for moving the workpiece pallet about the sewing surface at the sewing station so that a predetermined stitch pattern may be sewn on the workpiece; and a master controller for energizing the shuttle;

said workpiece pallet comprising:

mounting means for mounting the workpiece to said shuttle;

a frame member, said frame member having receiving means for receiving a locator plate for registering a workpiece in a fixed position in said frame member; and a universal coupler for permitting said frame member to be capable of pivotally and interchangeable receiving a plurality of preselected sets of said plurality of plates;

said universal coupler comprising a first connecting member for mounting on said frame member and a second connecting member for mounting on each of said plates, said first and second connecting members cooperating to permit at least one of said plurality of sets of plates to be pivotally and interchangeably mounted on said frame member such that said at least one of said plurality of set of plates becomes operatively aligned with said locator plate so that said workpiece can be clamped in said workpiece pallet;

said frame member lying in a plane and said first connecting member comprising at least one pin having an axis which is generally parallel to said plane, said second connecting member comprising at least one bracket member having detent means for engaging said at least one pin in order to interchangeably and pivotally secure at least one of said plurality of sets of plates to said frame member; and said at least one bracket member comprising a slot and said detent means comprising a spring loaded detent which is operatively associated with said slot.

11. A workpiece pallet for use with a sewing machine having a sewing station, said workpiece pallet comprising:

a frame member;

a locator associated with said frame member for locating a workpiece in said frame member; and pivot means for detachably and pivotally securing a plurality of plates to said frame member to secure the workpiece in said frame member so that said sewing machine can sew the workpiece when the workpiece pallet is positioned at the sewing station;

said locator comprising a base plate which is removably secured to said frame and said workpiece pallet further comprising locking means for locking said base plate to said frame.

12. A workpiece pallet for use with a sewing machine having a sewing station, said workpiece pallet comprising:

a frame member;

a locator associated with said frame member for locating a workpiece in said frame member; and pivot means for detachably and pivotally securing either one of a plurality of sets of plates to said frame member to secure the workpiece in said frame member so that said sewing machine can sew the workpiece when the workpiece pallet is positioned at the sewing station;

said plurality of sets of plates being comprised of at least a first set of plates and a second set of plates;

one or both of said first and second sets of plates comprising at least two plates.

13. A workpiece pallet which is capable of detachably and interchangeably receiving at least one of a plurality of sets of plates, said workpiece pallet comprising:

a frame member, said frame member having receiving means for receiving a locator plate for registering a workpiece in a predetermined position in said frame member; and a universal coupler for permitting said frame member to pivotally and interchangeably receive at least one of said plurality of sets of said plurality of plates;

at least one of said plurality of preselected sets of plates comprising at least two plates.

* * * * *

UNITED STATES PATENT AND TRADEMARK OFFICE

CERTIFICATE OF CORRECTION

PATENT NO. : 5,421,277

DATED : June 6, 1995

INVENTOR(S) : Ralph F. Conley, Jr. & Richard A. Cefola

It is certified that error appears in the above-indentified patent and that said Letters Patent is hereby corrected as shown below:

Column 12:
In Claim 1 line 42, delete --a plurality of--(second occurrence).

Column 13:
In Claim 7 line 62, delete --second--

Signed and Sealed this

Twenty-second Day of August, 1995

Bruce Lehman

*Attest:*

BRUCE LEHMAN

*Attesting Officer*

*Commissioner of Patents and Trademarks*